US009243370B2

(12) United States Patent
Christ et al.

(10) Patent No.: US 9,243,370 B2
(45) Date of Patent: Jan. 26, 2016

(54) SUPERSTRUCTURE DEVICE

(75) Inventors: Thomas Christ, Muhlhausen (DE); Thomas Bergk, Gotha (DE); Jürgen Hellbach, Gunthersleben-Wechmar (DE); Harald Kopilovitsch, Hetzendorf (AT)

(73) Assignees: VOESTALPINE BWG GMBH & CO. KG, Butzbach (DE); VOESTALPINE VAE GMBH, Vienna (AU)

( * ) Notice: Subject to any disclaimer, the term of this patent is extended or adjusted under 35 U.S.C. 154(b) by 128 days.

(21) Appl. No.: 13/697,401

(22) PCT Filed: May 12, 2011

(86) PCT No.: PCT/EP2011/057702

§ 371 (c)(1),
(2), (4) Date: Jan. 16, 2013

(87) PCT Pub. No.: WO2011/141550

PCT Pub. Date: Nov. 17, 2011

(65) Prior Publication Data

US 2013/0112816 A1 May 9, 2013

(30) Foreign Application Priority Data

May 12, 2010 (DE) ..... 10 2010 016 923
Aug. 23, 2010 (DE) ..... 10 2010 037 110

(51) Int. Cl.
*E01B 7/02* (2006.01)
*E01B 7/24* (2006.01)
*E01B 7/00* (2006.01)

(52) U.S. Cl.
CPC ... *E01B 7/02* (2013.01); *E01B 7/00* (2013.01); *E01B 7/24* (2013.01)

(58) Field of Classification Search
CPC ..... E01B 7/00; E01B 7/02; E01B 7/24
USPC ..... 246/415 R, 428, 435
See application file for complete search history.

(56) References Cited

U.S. PATENT DOCUMENTS

| | | | | | |
|---|---|---|---|---|---|
| 4,429,845 | A * | 2/1984 | Stover et al. | ..... | 246/428 |
| 5,824,997 | A * | 10/1998 | Reichle et al. | ..... | 219/537 |
| 6,550,722 | B1 * | 4/2003 | Kogler et al. | ..... | 246/442 |
| 2001/0025904 | A1 * | 10/2001 | Dietze et al. | ..... | 246/415 R |
| 2004/0113023 | A1 * | 6/2004 | Benenowski et al. | ..... | 246/435 R |
| 2010/0193597 | A1 * | 8/2010 | Christ et al. | ..... | 238/171 |
| 2012/0168569 | A1 * | 7/2012 | Christ | ..... | 246/435 R |

FOREIGN PATENT DOCUMENTS

| | | | | | |
|---|---|---|---|---|---|
| DE | 2042486 | B1 | 12/1971 | | |
| DE | 29824701 | U1 | 5/2002 | | |
| DE | 10112979 | C1 * | 7/2002 | ..... | E01B 7/02 |
| DE | 10124624 | A1 * | 10/2002 | ..... | E01B 7/02 |
| DE | 19920858 | C2 * | 2/2003 | | |
| DE | 102004048751 | B3 * | 12/2005 | | |
| DE | 102009026049 | A1 * | 12/2010 | ..... | E01B 5/08 |
| WO | WO 9623106 | A1 * | 8/1996 | ..... | E01B 5/08 |
| WO | WO 2004065691 | A1 * | 8/2004 | ..... | E01B 7/02 |

* cited by examiner

*Primary Examiner* — Zachary Kuhfuss
(74) *Attorney, Agent, or Firm* — Ladas & Parry LLP

(57) ABSTRACT

A superstructure device (10) for a set of points having a switch support which is composed of a block of high-strength steel and which has stock and short point rails which delimit said switch support and are formed integrally from the block, wherein the block is connected to a lower part composed of a material other than the high-strength steel, such as mild steel, and is in particular connected in a materially joined fashion, wherein the block extends essentially over the entire length of a switch rail device as the superstructure device on both sides beyond the switch support, and the lower part is a means of supporting the block in the form of at least two supports which are spaced apart from one another.

26 Claims, 14 Drawing Sheets

View A

Section C-C

Section B-B

Section D-D

BA ..Start of curve

Detail X

SUPERSTRUCTURE DEVICE

This application is a 371 of PCT/EP2011/057702 filed on May 12, 2011, which claims priority to German patent application number 10 2010 016 923.4, filed May 12, 2010, and German patent application number 10 2010 037 110.6, filed Aug. 23, 2010.

The invention relates to a superstructure device for a set of points with a switch support embodied as a block consisting of high-tensile steel, whereby the block is connected to, in particular with a metallurgic bond, to a lower part consisting of the same material or a material different from the high-tensile steel, such as structural steel.

A corresponding superstructure device with a lower part consisting of structural steel can be found in, for example, DE-C-101 24 624. The lower part and the upper part are embodied block-like and are connected by screwing, welding, or pinning. In this, the superstructure device extends along the entire length of the switch support. A design of this type can also be found in DE-C-101 12 979. In designs of this type, the stock rail and the side rail bordering the switch support are integral components of the superstructure device.

DE-U-298 24 701 discloses a superstructure device, in which the side rail is a separate component and the stock rail and the support for the switch blade are embodied as one component and form a long base block. In this, the base block may possess an H-shaped geometry, so that a hollow is formed between the longitudinal arms of the base block. A similar design is found in DE-B-20 42 486. In this, heating rods are arranged in the heater chamber and are pressed to the lower side of the tongue support by means of a tension plate. The plate extends at some distance from the bottom of the hollow.

Known from DE-B-10 2004 048 751 is a switching device with a base block of wear-resistant tempered steel, which is manufactured by cutting processing. Below a switch support that supports the tongue blade, the stock rail delimits a hollow, in which a heating device is provided.

In the superstructure devices known in the art, the block forming the switch support only extends along a portion of the total length of the switching device, whereby the ends are welded to standard rails in order to form the complete switching device.

The objective of the present invention is to develop a switching device of the above-mentioned type in a way so that simplifications and material savings take into account individual circumstances. It should also be made possible to integrate the superstructure device into a track system without problems.

Under a further aspect, it should be possible to heat the switching device in the area of the switch support in an energy-saving manner.

To meet the objective of one aspect of the invention, it is suggested that the block extend over the length of the switch support as well as at least beyond one side of the switch support, and that the lower part be an elevated support of the block in the form of at least two supports spaced at some distance from one another. The lower part, which also may comprise a base plate, to which the supports are connected, i.e. welded, may consist of the same high-tensile steel as the block, or of a different material, which also includes a high-tensile steel different from the material of the block, in particular structural steel.

In particular it is intended that the block along the entire length of the switching device extend on both sides beyond the switch support. In this, the length of the switching device corresponds to the standard length.

However, it is also possible that the block extends only beyond at least one side of the switch support. In this, it is in particular intended that the block extend at least to the entrance or beginning of the switching device, whereas on the exit side of the switching device either the stock rail or the tongue blade or both the stock rail and the tongue blade can be provided with a transition rail profile or standard rail profile, which is welded on in the factory.

The invention makes available a superstructure device, in which the block comprising the switch support and the side rail and stock rail delimiting the switch support, as well as adjacent sections of the switching device, integrally consist of high-tensile steel, providing high wear-resistance. But at the same time, the design of the superstructure device allows material savings during manufacture, since the lower part is not embodied block-like, but consists of two spaced apart supports, in particular consisting of structural steel, that delimit a space, in which to the desired degree one without problems disposes a heater in such a way that it can be operated in an energy-saving manner. However, this design remains cost-effective even if the lower part also consists of high-tensile steel, since material is only required for the supports or for the supports and the base or mounting plate, from which the supports originate or to which the supports are joined, i.e. welded.

However, the scope of the invention also comprises variants of a design, in which the block does not extend beyond both sides of the switch support along the entire length of the switching device. This deviation may be required due to constructional or site-specific circumstances or requirements. Site-specific deviations then may lead to a change in length, for example when a fit into existing gaps in track is to be accomplished. But also welding processes prescribed by the customer, which are easier to apply to conventional rails than to rails of high-tensile quality in a section of rail to be welded can be reason for a shorting.

Structural deviations are deviations from the standard total length, which cause shortening and/or lengthening of the total length in interleaved switching devices of complex track installations, e.g. ladder tracks, consecutive branchings, or mixed-gauge switching systems.

A lengthening of the monoblock design may be required in order not to increase the number of welding joints between the subassemblies. Short extensions, e.g. up to 400 mm, are integrated in the monoblock of the switching device, while longer extensions, e.g. in excess of approximately 400 mm, are accomplished effectively using factory-welded standard rails. Depending on the particular installation, the lengthening may be applied before the end of the actual switching device, so that as a result the monoblock design that usually has the length of the switching device, will be shortened accordingly, so that the unit monoblock-extension in length exceeds that of the switching device.

In other words, the block always extends along the entire length of the switching device, but can be lengthened or shortened to the required degree, in particular the latter, in order to avoid process-specific expenses for the welding of the standard rail to components of high-tensile quality steels and structural steel on site and to be able to manage constructional peculiarities of track systems in a cost-effective manner.

Thus, in accordance with an embodiment variant it becomes possible to make available a superstructure device in accordance with the invention, in which the block extends beyond the length of the switch support, but not along the entire length of the switching device. In this case, the block in the region in which it does not match the extent of the switching device preferably is welded to a standard rail, which then forms a unit together with the block. At least the block then is supported on the elevated support in accordance with the invention in form of at least two spaced-apart supports.

Different from switching devices known in the art, the superstructure device with respect to the switch support is embodied as a monoblock beyond the switch support, whereby in particular the superstructure device extends to the entrance or beginning of the switching device. Also provided is the option that at least the end section of the stock-rail side or the end section on the tongue-blade side or both the sections on the stock-rail side and the tongue-blade side of the switching device are parts of the monoblock.

If the block does not extend over the entire length of the switching device, transition rail profiles or standard rail profiles will be welded to the remaining sections, thus enabling a simple connecting to the connecting rails in the track. However, it is in particular intended that the invention's superstructure device extends along the entire length of the switching device and be embodied as a monoblock, without the welding of rails being required within the switching device. In this case the block consequently comprises the entrance of the switching device in form of a stock rail and the end section of the switching device, i.e. the stock rail and the tongue blade.

If in accordance with the invention's teaching, the superstructure device is embodied over the entire length of the switching device, then for an R50 set of points, for example, it is intended that the switching device on principle possess a length of approximately 5350 mm, i.e. approximately the length that a standard switching device possesses for an R50 set of points. Site-specific extensions or reductions for the purpose of improved welding in the track installation, for example, do not restrict the scope of the invention's teaching. Thus, the specified numbers should be seen in perspective. The relevant fact however is that the block is longer than the switch support and fundamentally extends along the entire length of the switching device. The lengths of the blocks for other rails are the following, taking into account the above qualification:

R25: approximately 4900 mm
R30: approximately 4600 mm
R50: approximately 5350 mm
R100: approximately 7200 mm
R150: approximately 8500 mm.

The block, which comprises the switch support and the stock rail and side rail integrally formed from the latter as well as the entrance and/or the end of the switching device delimiting the switch support should consists of a rolled plate or forged body, from which the superstructure device with its sections is carved by laser cutting, autogenous cutting, thermal cutting, plasma cutting, or milling.

In its original state, the block may possess a width of approximately 370 mm and a height of approximately 100 mm, in order to ensure an optimal material utilization.

The supports forming the elevated support preferably should be connected to the block with a metallurgical bond, whereby the respective outer side of a support possesses a flush transition to one of the outer sides of the block.

Further, the supports should originate from a base or mounting plate and in particular should be welded to it. In this, it is intended in a special configuration of the invention that from the interior space delimited by the lower side of the block, i.e. the tongue support supporting the tongue blade, the inner sides of the supports forming the elevated support, as well as the inner surface of the base or mounting plate extending between the supports, will be thermally insulated at least towards the base or mounting plate by introducing insulation, i.e. will be independent of insulation by air alone. This can be accomplished by pouring, foaming, or by introducing loose insulating material. It is also possible to arrange an insulating board with high thermal insulation or low heat-transfer coefficient along the base or mounting plate, possibly at some distance from the latter.

For improved thermal insulation it is further intended that the insulation introduced into the interior space be covered at least on the block side by a thermal shield plate, such as a rust-free plate such as stainless steel, which possesses poor heat conduction. Consequently, the space accommodating the heater is insulated at least towards the ground in a manner allowing an energy-saving heating operation.

As further configuration it is possible that the space accommodating the heater is not only insulated towards the ground, but also towards the elevated support, i.e. the supports with rectangular cross-section, whereby pouring, foaming, or introduction of loose insulating material may also take place here. In this, the insulation preferably also is covered by a thermal shield plate towards the interior.

With respect to the hollow extending below the switch support and its thermal insulation it should be noted that the invention's teaching in this regard is independent of the embodiment of the switching device itself. On the contrary, the teaching in this respect may be applied wherever a heatable hollow extends below a slide plate on which a tongue blade is supported. Consequently the invention also relates to a superstructure device comprising a box-type body, which delimits an interior space that on the fore side is delimited by a slide plate supporting the tongue blade of a set of points, and on the bottom side is delimited by a base or mounting plate, and in which is arranged a heater, which is characterized in that the interior space is thermally insulated by insulation introduced separately into the interior space at least towards the base or mounting plate, whereby the heater, such as a heating rod, is arranged between the insulation and the lower side of the slide plate.

In a special further development of the invention, it is intended that in the outer side of the stock rail and/or guide rail run a recess such as a relief or step, that the recess reach up to a height that is above the top side of the slide plate, and that in the recess an insulation such as insulating wool or an insulating plate be arranged.

These measures serve to insulate the stock rail or side rail towards the exterior in a region where the slide plate extends and the tongue blade is supported on the latter. This provides insulation in the contact region, so that a freezing is prevented in the colder season.

It is further intended that the insulation be covered on the outside, in particular be sealed watertight. For this purpose, the insulation may be sealed or covered on the outside by sheet metal or a support that supports the block or the switch support.

In a design of this type, the stock rail, in particular on its outside, possesses a step, forming a hollow between the vertical section and the outer cover, which is filled by insulation. In this, the insulation can extend from the horizontally extending upper section of the step to the base or mounting plate of the switching device. It is also possible however that the section of insulation that extends between the stock rail or side rail and the outer cover blends into the insulation surrounding the heater.

In accordance with a teaching of independent inventive merit it is intended that the support on the stock-rail side or switch-support side possesses spaced-apart projections, in particular exhibiting a comb-like geometry, on which the block or the switch support are supported. This measure serves to reduce the contact area between the support and the block or switch support, resulting in a lower heat transfer. Heat conduction between the base plate and the support and thus the ground is reduced.

Spaces extending between the projections may be filled with sections of insulation that in particular form a unit with the insulation present in the interior or blend into the latter.

In particular it is intended that outside of the heater the insulation extend along the lower side of the slide plate and/or outside of the stock rail all the way into or nearly into the region, where the tongue blade contacts the sliding side or the stock rail on the inner side.

With respect to the insulation, in particular the outside insulation of the stock rail, it should be noted that the invention's teaching in this regard does not necessarily relate to block designs. On the contrary, this type of insulation is also feasible for conventional switching devices, e.g. of VDV design. In this respect, the teaching relating to the insulation should be evaluated independently of any special design of switching device.

A superstructure device with a switch support consisting of a steel of high-strength quality, comprising a stock rail, a side rail, a tongue blade, and a slide plate supporting a set of points, whereby the block is connected, in particular by a metallurgical bond, is further characterized in that the switch support consists—in order to form a block—of individual parts that are connected by metallurgical bonds, in particular the stock rail, the slide plate, and the side rail, and that the lower part is an elevated support of the block in the form of at least two spaced apart supports.

This design achieves the same advantages as the invention's monoblock design. In this regard, we refer to the corresponding explanations and illustrated features that also apply to the alternative solution.

Further details, advantages, and features of the invention are not only found in the claims, the characteristic features described therein—individually and/or in combination—but also in the following description of preferred embodiment examples illustrated in the figures.

Figure 6:
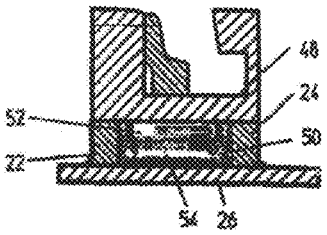
Figure 7:
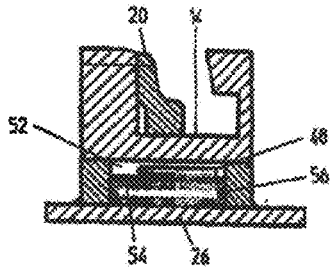
Figure 8:
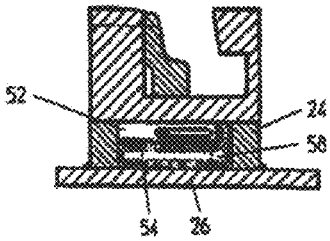
Figure 9:
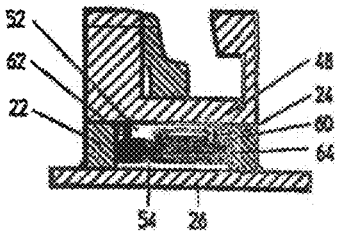
Figure 10:
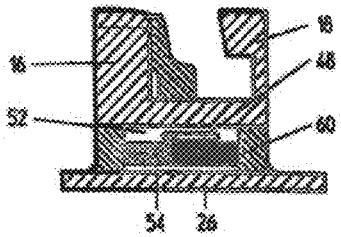
Figure 11:
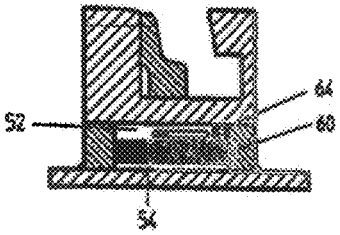
Figure 12:
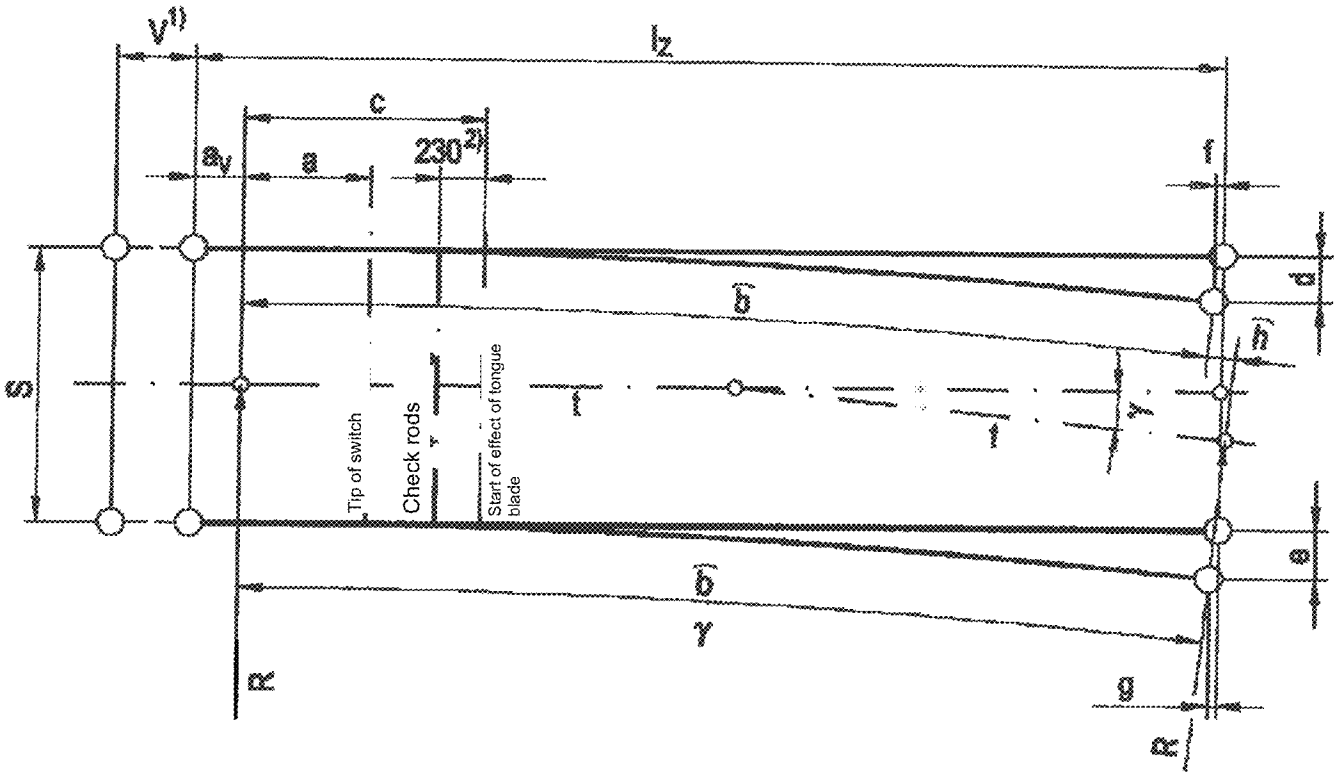
Figure 13:
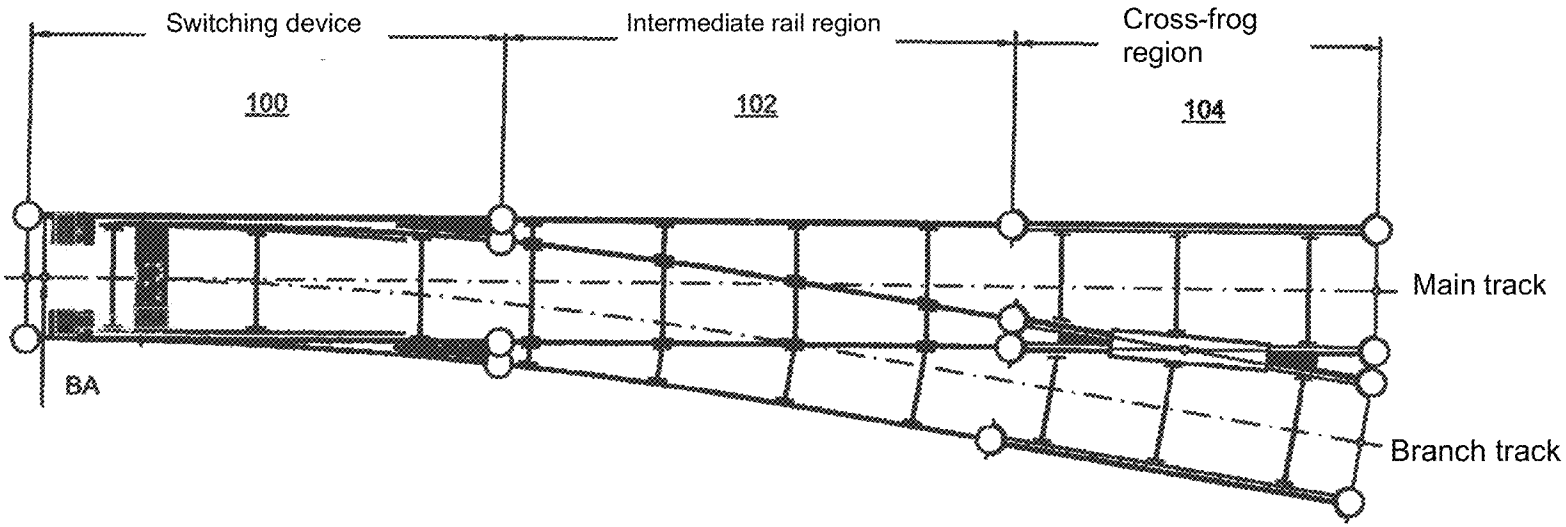
Figure 14:
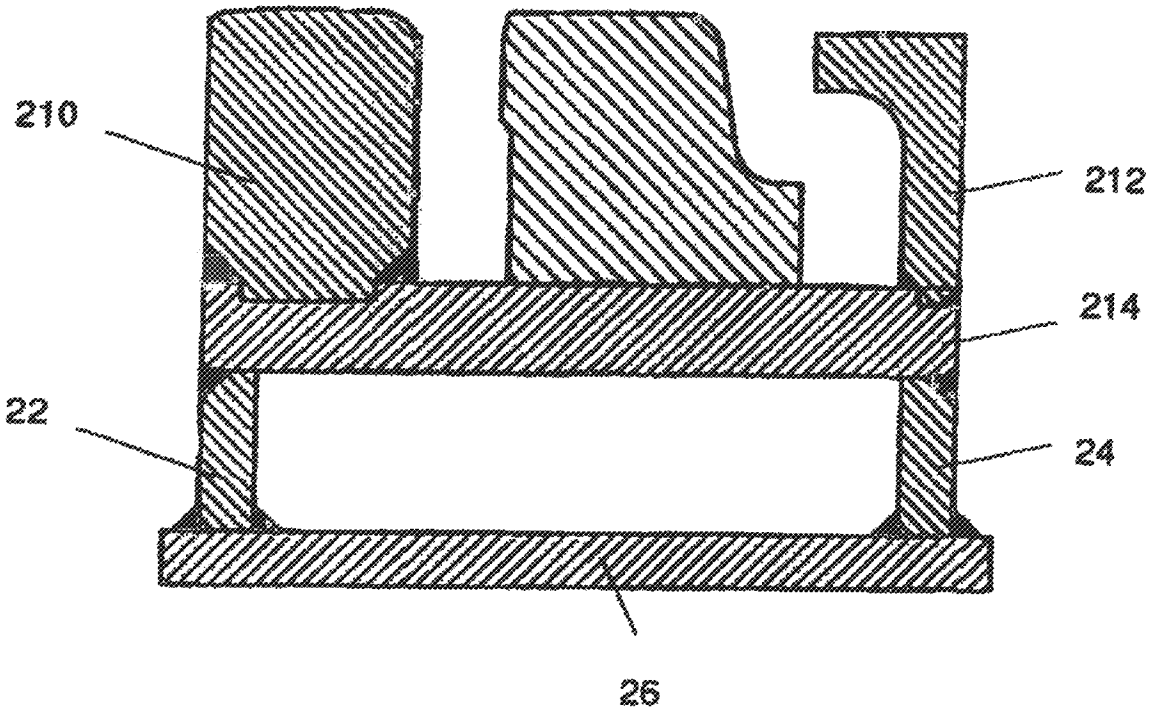
Figure 15:
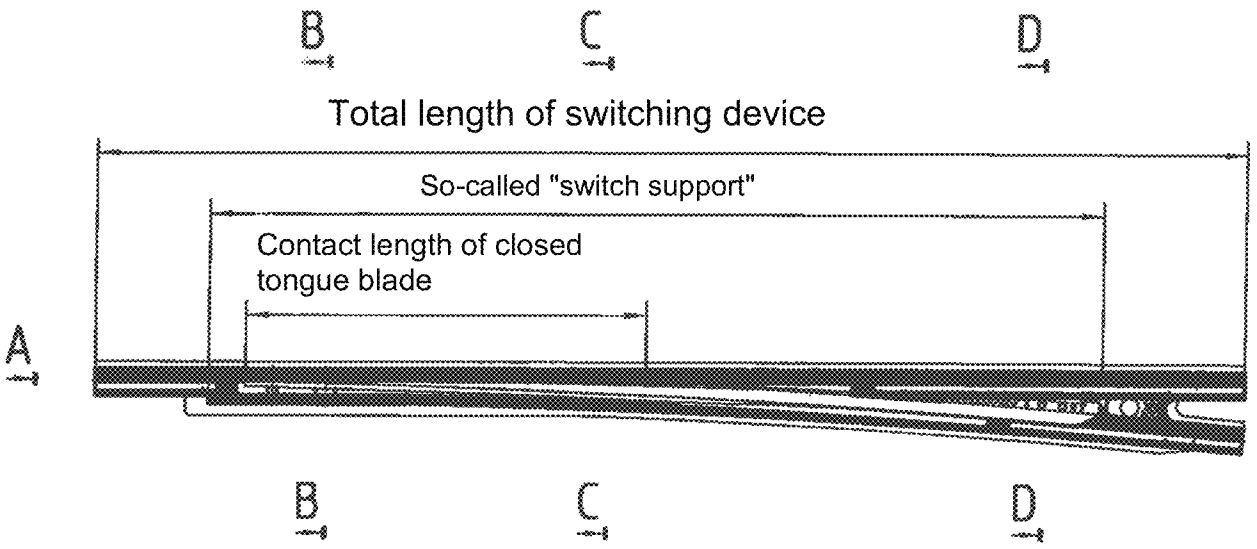
Figure 16:
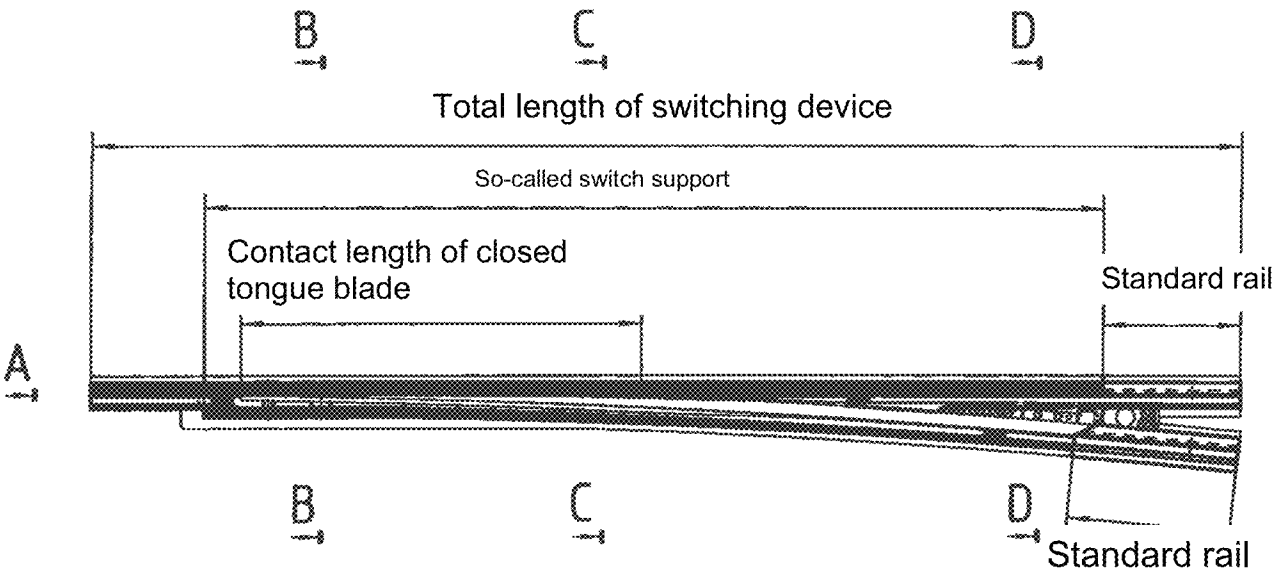
Figure 17:
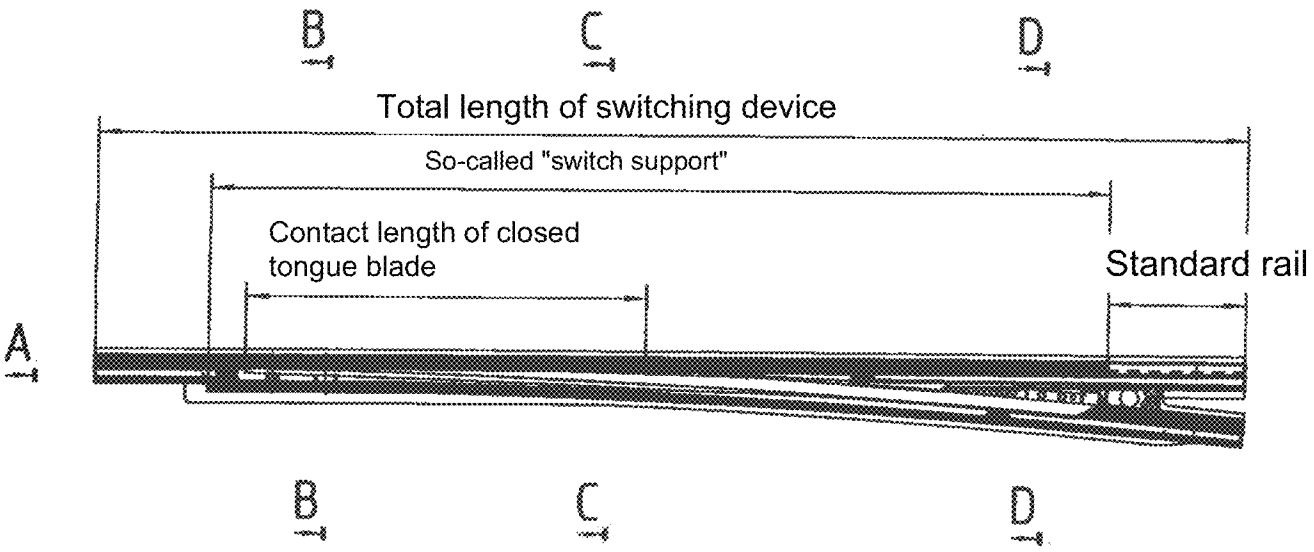
Figure 18:
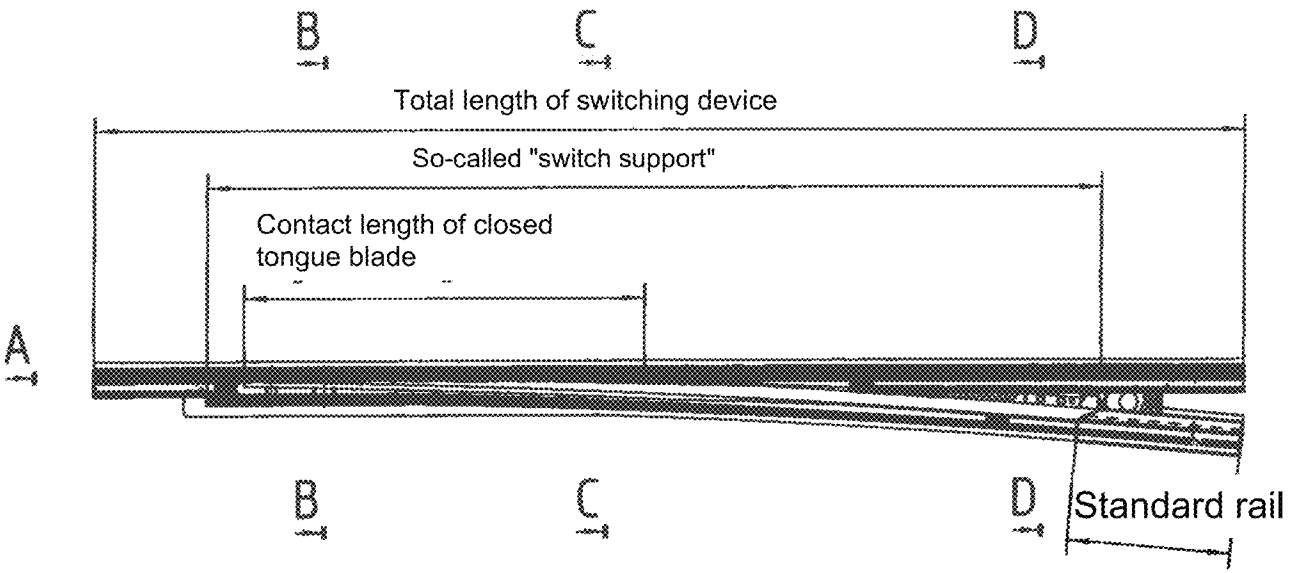
Figure 19:
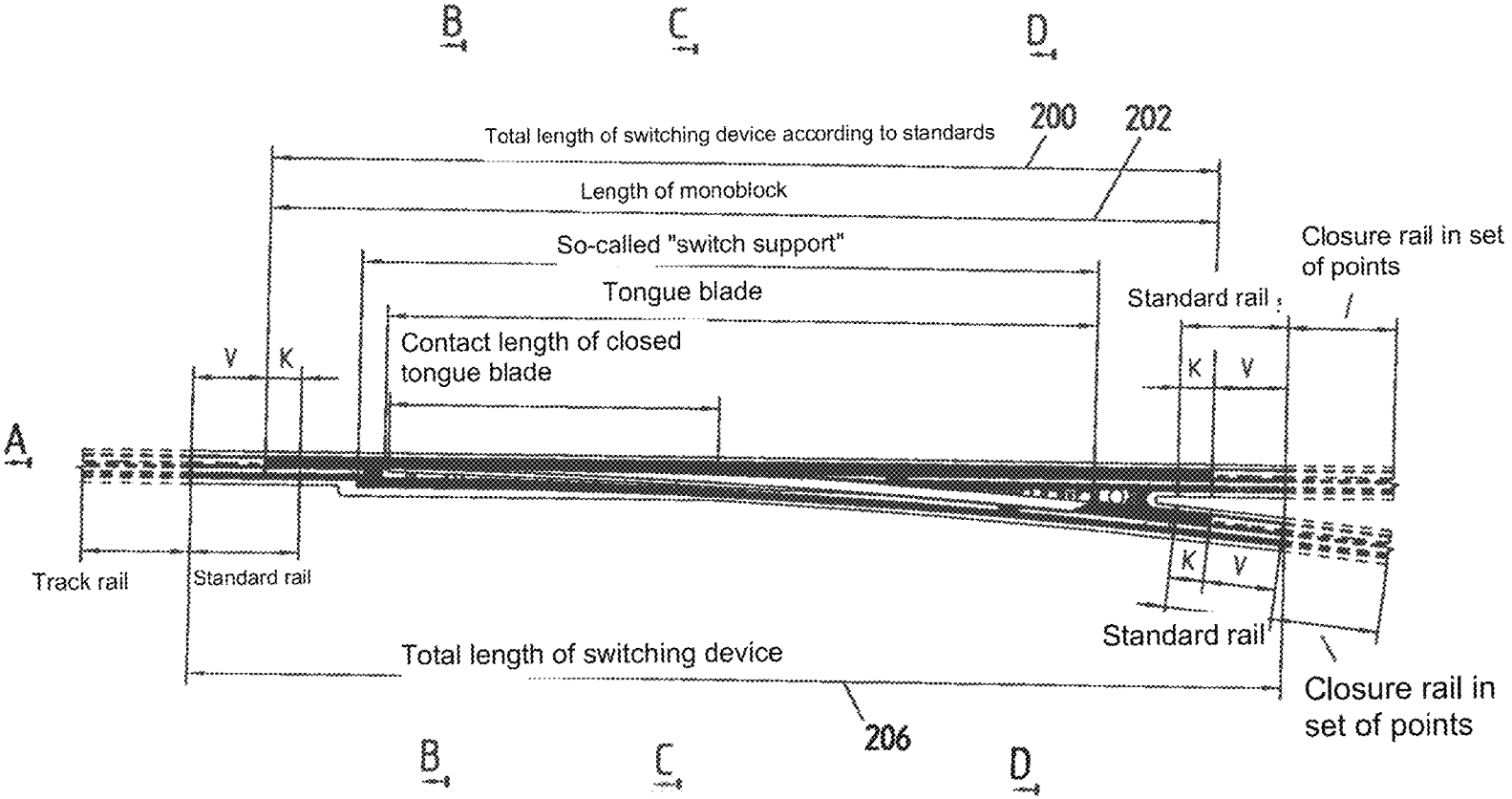
Figure 23:
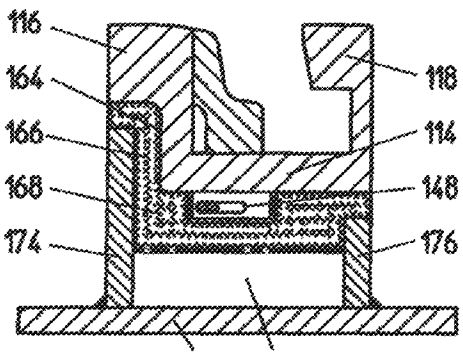
Figure 24:
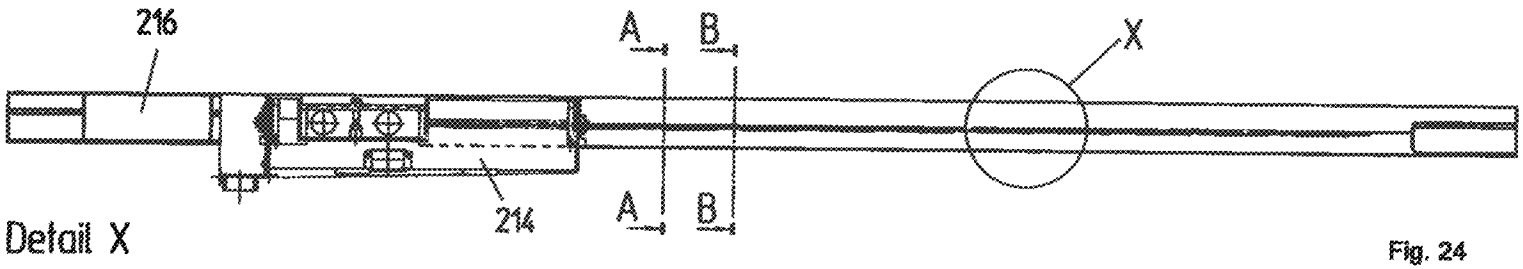
Figure 26:
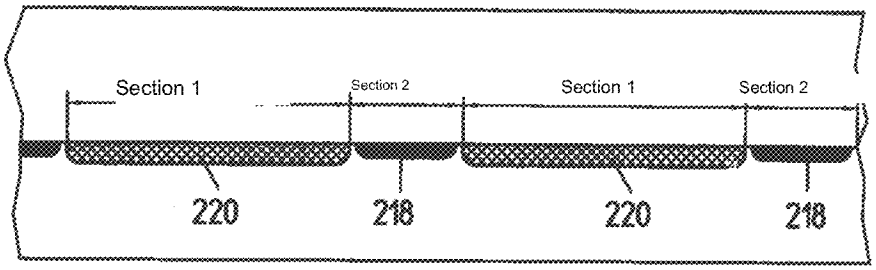
Figure 25:
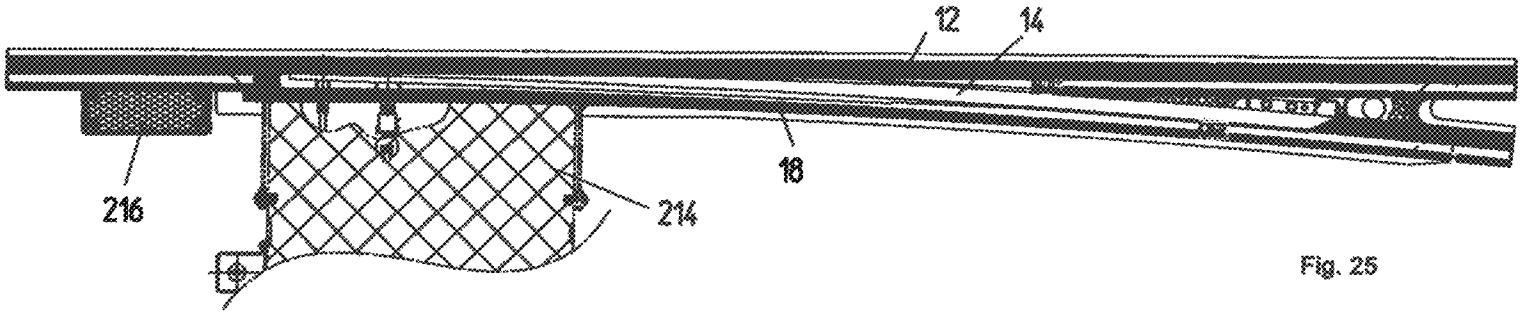
Figure 27:
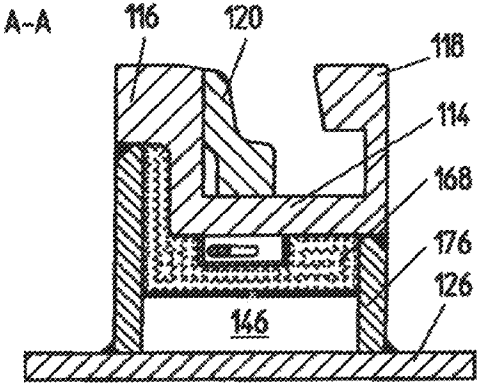
Figure 28:
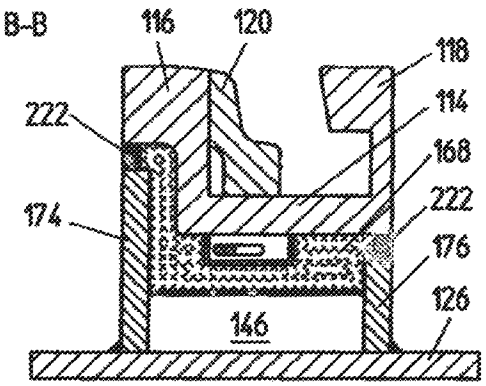
Figure 29:
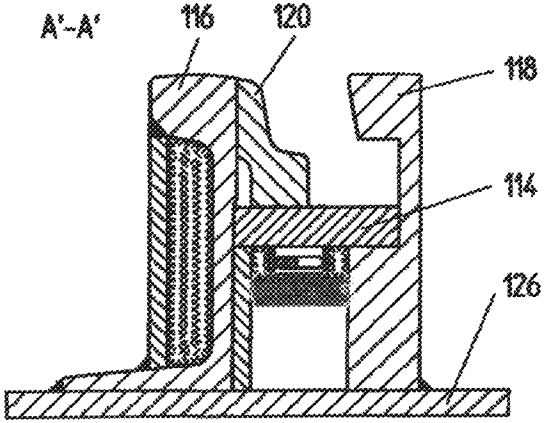
Figure 30:
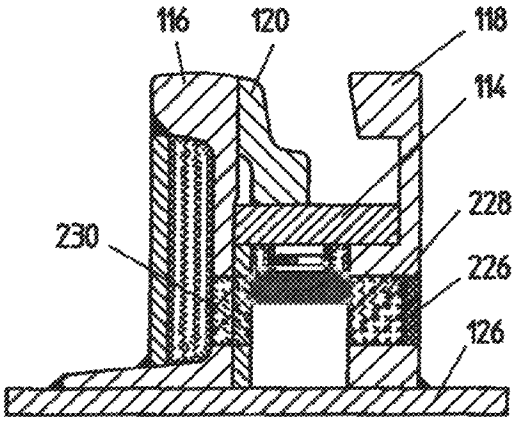

FIG. 6 shows a first embodiment variant of a chamber heater present in the switching device, FIG. 7 shows a second embodiment variant of an insulated chamber heater, FIG. 8 shows a third embodiment variant of an insulated chamber heater, FIG. 9 shows a fourth embodiment variant of an insulated chamber heater, FIG. 10 shows a fifth embodiment variant of an insulated chamber heater, FIG. 11 shows a sixth embodiment variant of an insulated chamber heater, FIG. 12 shows a top view onto a switching device with identifiers according to VDV guidelines, FIG. 13 shows a schematic illustration of a set of points, FIG. 14 shows a sectional view of a second embodiment variant of a switching device, FIGS. 15-18 shows variants of monoblock switching devices according to the invention, FIG. 19 shows a summary view of possible variants of monoblock designs, FIGS. 20-23 show sectional views of various embodiment variants of switching devices with insulation, FIG. 24 shows a side view of a further embodiment variant of a switching device, FIG. 25 shows a top view onto a switching device according to FIG. 24, FIG. 26 shows a detail X of FIG. 24, FIG. 27 shows a sectional view along the line A-A of FIG. 24, FIG. 28 shows a sectional view along the line B-B of FIG. 24, FIG. 29 shows a first sectional view through a further embodiment variant of a switching device, and FIG. 30 shows a further sectional view through the switching device of FIG. 29.

In the following description of the invention's superstructure device the invention is explained using the example of a grooved-rail superstructure device, whereby this does not limit the scope of the invention's teaching.

Moreover, for simplification purposes, on principle the same reference labels are used for identical elements.

For the purpose of explaining and defining the invention in comparison to the state of technology, FIG. 12 shows a schematic illustration of a switching device with a nomenclature in accordance with VDV guidelines. Further, FIG. 13 shows a schematic illustration of a set of points that consists of a switching device 100, a closure rail region 102, and a cross-frog region 104. In accordance with FIG. 12, the switching device has a total length of V +lz, whereby V is an extension V beyond the length lz at the start of the set of points, which must be taken into account when using an electrical chamber heater.

Figure 1:
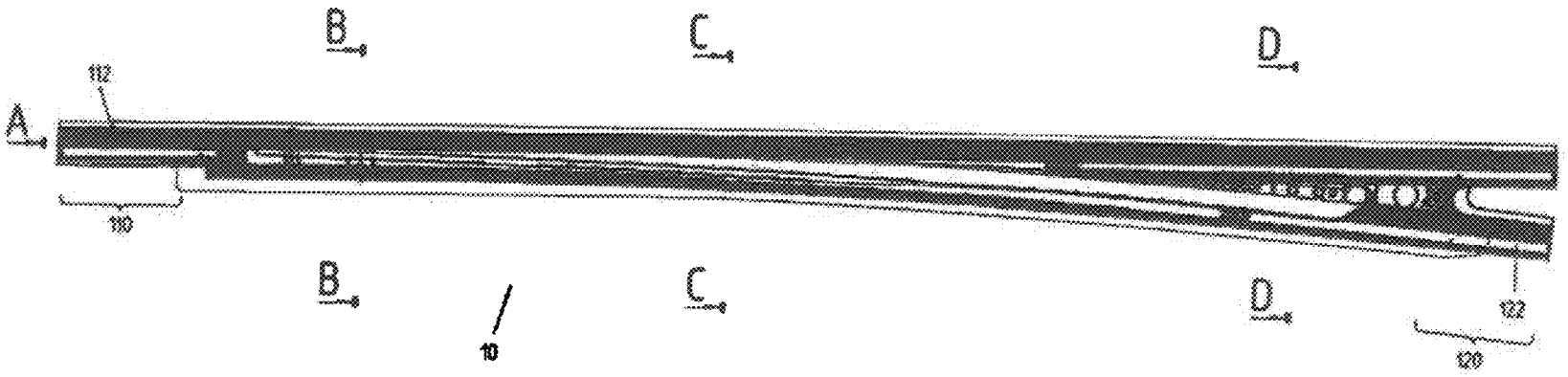
FIG. 1 shows a top view onto a switching device.

A switching device 10 as the superstructure device according to the invention that is illustrated in a top view in FIG. 1 possesses a length lz+V, whereby in accordance with the guide values for the invention's switching device in dependence on the points radius one obtains the following values, whereby the usual tolerances and site-specific lengthening or shortening for the purpose of improved welding in a track insulation should be taken into account:

R25: 4900 mm
R30: 4600 mm
R50: 5350 mm
R100: 7200 mm
R150: 8500 mm.

The blackened areas in the switching device 10 of FIG. 1 are meant to symbolize that a single-piece block 12 extends over the entire length of the switching device 10 and consists of a steel of high-tensile quality with a strength of up to 1600 $N/mm^2$ or more, in particular a strength between 1200 $N/mm^2$ and 1600 $N/mm^2$ or more. As examples one should mention the steels known under the designations DILLIDUR, or XAR, or HARDOX, or BAINIT.

From the block 12 is produced a switch support 14, e.g. by CNC milling, thermal cutting such as autogenous cutting, plasma cutting, or laser cutting, which is delimited by a stock rail 16 and a side rail 18, which consequently are integral components of the block 12. Arranged in a movable manner to the desired degree on the switch support is a tongue blade 20.

The switch support extends approximately along the length between the sections B-B and D-D and is delimited by a beginning 110 (entrance) with stock-rail section 112 and an end section 120 with a curved standard rail 122. The end section 120 and the beginning 110 can be sections of the block 12.

However, it is also possible that the entrance and/or end sections are not sections of the block 12, but consist of transition or standard rail profiles. This serves to prevent expensive welding of the standard rail to components of high-tensile steel and structural steel on site. The step of connecting short-transition rail profiles in the entrance and end sections can be performed in the factory.

While a block design is part of the state of technology, this is not true with respect to its length, since in accordance with the state of technology the block has a length that corresponds to that of the switch support.

Different from designs known in the art, the invention further intends that the block 12 not be connected to a block-like lower part, but rather to supports 22, 24 with rectangular cuboid geometry, i.e. with rectangular cross-section, such as square profiles of structural steel, and consequently be supported at elevation on these, whereby the supports originate in a base of mounting plate 26. In this, the supports 22, 24 preferably are connected with metallurgical bonds both to the block 12 and the base plate 26. Also evident in the figures is that the outer sides 28, 30 of the elevated support, i.e. of the supports 22, 24, are aligned with the outer sides 32, 34 of the block 12.

The supports 22, 24 and the base plate 26 may be referred to as the lower part or only the supports 22, 24 may be referred to as lower part.

The elevated support consists of a material such as structural steel and consequently can be produced in a cost-effective manner.

Figure 5:
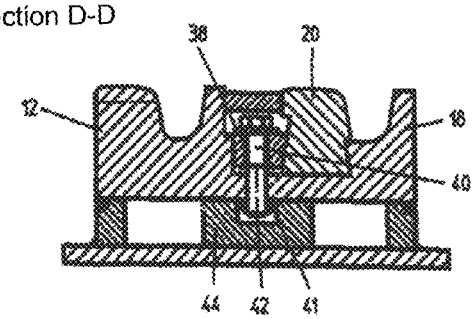
FIG. 5 shows a sectional view along D-D in FIG. 1.

As is illustrated in FIG. 5 (sectional view D-D), the tongue blade 20 in the region of the heel of points can be fixed by a wedge 38 that is braced in the direction towards the bottom of the block 12. A screw element 40 that is required for this and passes through the wedge element 38 can be tightened via a screw nut 41 that is present in a chamber recess 42 of a further support 44 of rectangular cuboid geometry, which in the region of the section D-D represents a section of the elevated support for the block 12, in order to move the wedge element 38 in the direction towards the bottom of the block 12 during fastening of the tongue blade 20 or to loosen the wedge 38 during exchange of the rail 20.

The invention's teaching creates the possibility of heating the switching device to the desired degree in an energy-saving manner. For this purpose one has the option of introducing—in accordance with the following explanation—into the interior space 46 delimited between the base plate 26, the supports 22, 24, and the lower side of the block 12, a heater such as a heating rod 48, which is insulated to the required degree towards the supports 22, 24 and the base plate 26 by means of an insulating material—in a simplifying manner referred to as insulation—, so that as a result heat losses are minimized and the desired heating of the switch support 15 that supports the tongue blade 20 takes place.

For example, in accordance with FIG. 6, an insulation element 50 can be embodied with a U-shaped cross-section, in order to insulate the space 52 that accommodates the heating rod 48 both towards the supports 22, 24 and the base plate 26. In this, the insulation 50 may consist of a foamed material, of a poured material, or of loose insulating material, which towards the space 52 is covered by a thermal shield plate 54 that features poor thermal conduction. This can be a rust-free sheet steel, i.e. in particular stainless steel.

In accordance with the embodiment example of FIG. 7, the space 52 accommodating the heating element 48 is insulated towards the base plate 26, whereby the insulation 56 may also be covered by a thermal shield plate 54 and be introduced by pouring, foaming, or in loose form.

In the embodiment example of FIG. 8, the interior space 46 is partially filled with insulation 58 that has an L-shaped cross section, so that the space 52 is insulated toward the base plate 26 and the right support 24. Apart from this, the insulation 58 may be embodied in accordance with the explanation in connection with FIGS. 6 and 7 and can also be covered by a thermal shield plate 54.

Also used as insulation 60 in accordance with FIG. 9 may be an insulating board 60 with high thermal-insulation or low heat-transfer coefficients. In the embodiment example, the insulation extends in parallel to and at some distance from the base plate 26, whereby the space 52 that accommodates the heating rod 48 or another suitable heater is also thermally insulated towards the supports 22, 24, whereby an insulation in accordance with FIGS. 6 to 9 may be provided, i.e. insulating material in poured, foamed, or loose form, whereby the insulation 62, 64 may be covered by a thermal shield plate 54 towards the space 52. This also applies to the insulation 60, i.e. the insulating board 60 or any other suitable insulating material.

In FIG. 10, the insulation 60 extends exclusively parallel to the base plate 26 in the form of an insulating board with a thermal shield plate 54 covering it towards the space 52.

The embodiment example of FIG. 11 is similar to that of FIG. 8, so that the space 52 is surrounded by an insulation with an L-shaped cross section, which is composed of the insulation 60 on the one hand and the insulation 64 on the other, which in turn are covered by a thermal shield plate 54 towards the space 52.

FIGS. 20-23 illustrate further embodiment variants of switching devices with insulation intended to facilitate an energy-saving heating and to achieve the desired degree of insulation to prevent or reduce freezing of the contact surfaces of the tongue blade to the stock rail and the slide plate. In this, the following description on principle uses the same reference labels for identical elements.

Figure 20:
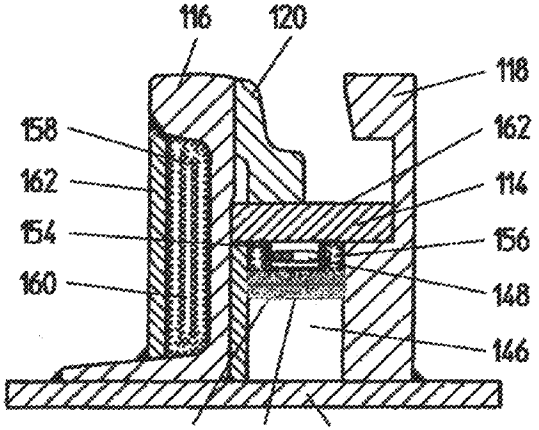

FIG. 20 shows a sectional view of a switching device consisting of welded profiles and construction profiles, similar to a switching device of VDV design, which consists of a stock rail 116, a side or guide rail 118, as well as a slide plate 114, which extends between the two rails and is supported on the side rail 118 and a support that extends along the inside of the stock rail 116.

The stock rail 116 and the guide rail 118 originate from a base plate 126. A tongue blade 120 is moveable on the slide plate 114.

The guide rail 118, the slide plate 114, and the stock rail 116 delimit an interior space 146, also referred to as a chamber, in which a heater 148 is located underneath the slide plate 114. This is surrounded by an insulation 150, which in the embodiment example is composed of a sandwich-type insulating plate 152 extending below the heater 148 and insulating elements laterally surrounding the heater 148, preferably in the form of insulating wool. In this regard, the design or extent of the insulation chosen corresponds to the one illustrated in FIG. 9, for example.

Deviating from the embodiment variants of FIGS. 6 and 11, the switching device in the region of the stock rail 116 is additionally insulated on the outside. For this purpose, the stock rail 116 on its outside exhibits a chambered recess, which is closed towards the outside by for example a sheet-steel plate 162 that is welded to the railhead and foot of the stock rail. In this, the chamber recess 158 extends to above the upper side 162 of the slide plate 114, possibly into the contact region between the tongue blade 120 and the stock rail 116, in order to insulate the contact surfaces of the tongue blade towards the stock rail 116 or slide plate 114 to such a degree that freezing does not take place.

Figure 21:
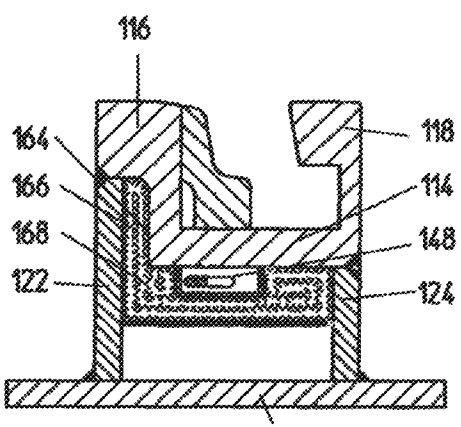

FIG. 21 illustrates a block version of a switching device corresponding to the invention's teaching, i.e. with a block of high-tensile steel comprising the stock rail 116, the slide plate 114, and the side or guide rail 118, that rests on an elevated support with supports 122, 124 as lower part, which in turn originate from a base or mounting plate 126.

As is self-evident in the drawing's illustration, the stock rail 116 on its outside possesses a step-like recess 164, which on the outside is at some distance delimited by the support 122, resulting in a space 166 delimited by the step, which is filled with insulation 168 that extends to below the slide plate 114 and surrounds the heater 148. Consequently the insulation 168 possesses an L-shaped geometry.

Figure 2:
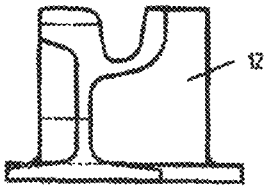
FIG. 2 shows a sectional view along A-A in FIG. 1.
Figure 22:
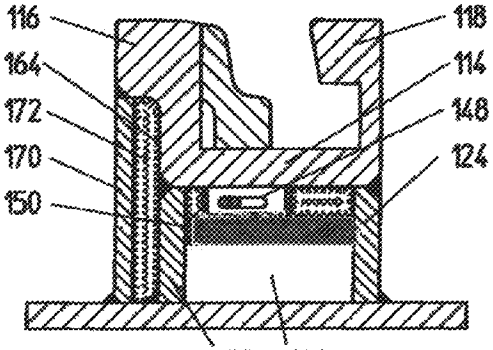

The switching device illustrated in the sectional view of FIG. 22 with respect to the switch support also is embodied in block design, but different from the design of FIG. 2, it is supported by supports 122, 126, one of which, in particular the left support 122, extends offset to the inside and —like the support 124—originates at the lower side of the slide plate 114. The stock rail 116 also possesses a step-like recess 164 in its outer side in order to provide a space into which insulation 172 is introduced. In the embodiment example, the space 172 is delimited on the outside by a cover 170 such as sheet metal joining the outer side of the head of the stock rail 116 in a flush manner and the support 122, that is welded to the lower side of the slide plate 114, as mentioned above. The interior space 146 between the inner support 126 and the support 126 extending in the region of the guide rail 118 in accordance with the above-explained embodiment examples is provided with the heater 148 and an insulation 150 in accordance with FIG. 20.

FIG. 23 illustrates a special design of a switching device with its own inventive merit, whereby the switching device possesses a block design in as far as the stock rail 116, the guide rail 118, and the slide plate 114 are embodied as a block of high-tensile steel that is elevated and supported by supports 174, 176, which originate from a base or mounting plate 126.

In accordance with the embodiment examples of FIGS. 21, 22, the stock rail 116 on the outer side possesses a step-like recess 164, whereby the support 174 extends at some distance to the vertical section of the step-like cut-out 164, in order to provide a gap 166, into which the insulation 168 may be introduced, which extends into the interior 146 below the heater 148.

However, different from the design of FIG. 21, the block rests on the supports 174, 176 not in a plane two-dimensional manner but rather in a quasi-point-like manner, i.e. the upper edge of the supports 174, 176 possesses a comb-like geometry that is formed by spaced apart projections with preferably rectangular cross-section, that are connected, in particular with a metallurgical bond, to the block, in particular to the lower side of the stock rail 116, i.e. the horizontally extending section of the step 164, on the one hand, and the lower side of the slide plate 114 in the region of the guide or side rail 118 on the other. The space between the projections is filled with insulating material, as is illustrated by the sectional view of FIG. 23.

The design of this type is to be illustrated again by FIGS. 24-28. FIG. 24 shows a side view of a switching device, which may correspond to the invention's teaching with respect to the block design of the upper part and the supports of the lower part in accordance with FIGS. 1-5. Illustrated purely schematically in addition to the stock rail 12, the guide or side rail 18, and the tongue blade 14 are an adjusting system 214 for shifting the tongue blade 14 as well as a box 216 for a heater.

As is illustrated by the detail X of FIG. 26, the upper part, i.e. the switch support, which consists of high-tensile steel and comprises the stock rail 12, the side rail 18, as well as the slide plate 14, is not supported on the supports 22, 24 in a plane two-dimensional manner but rather via spaced apart projections of the supports 22, 24, as was explained in connection with FIG. 23. The corresponding supports are identified by the reference labels 174, 176.

It is apparent in the illustration of FIG. 26, that the projections are welded in sections to the block-like switch support in the regions labeled "Section 2". This is indicated by the filled rectangular welding sections 218. Between the projections, the supports 22, 24 or 174, 176 extend set back relative to the switch support, creating a free space that is filled with an insulating material 220. This is indicated by the hatched areas in FIG. 26.

The sectional views A-A and B-B of FIGS. 27, 28 then lead to designs as they are illustrated in FIG. 23, whereby FIG. 28 corresponds to FIG. 23 and FIG. 27 shows a cross-sectional view of the switching device, in which the switch support is supported on the supports 174, 176 or 22, 24 and is connected to them by a metallurgical bond.

Different from the illustrations of FIG. 23, FIG. 28 illustrates that the insulation, which extends into the gap between the projections, is sealed on the outside by a material that prevents the ingress of moisture. The corresponding areas are identified by the reference label 222.

This design intended to reduce heat conduction between the lower part and the upper part of the switching device is also feasible for conventional switching device designs, the basic principle of which is illustrated by FIGS. 29, 30. These figures show sectional views of a switching device that consists of normal rails. This switching device consequently can be a switching device of VDV design or similar type, which corresponds to the illustration in FIG. 20, so that corresponding reference labels are used.

A comparison of FIGS. 29 and 30 illustrates that in the stems of both the stock rail 116 and the side rail 118 are provided passages, such as bore holes, that are filled with an insulating material 228, 230.

FIGS. 29, 30 are meant to illustrate the principle that the reduction of thermal losses by introduction of insulation in the transition region between the upper and lower part of a switching device possesses it own inventive merit independently of the particular design.

The above-described characteristic features of the invention with respect to the insulation of the interior space have their own inventive merit and apply irrespectively of whether a monoblock design according to the invention is used or not.

On the contrary, the teaching in this respect can be applied wherever there is a hollow space that is situated below a plate supporting the tongue blade and in which a heater is arranged.

FIG. 14 illustrates an independent solution, which differs from the monoblock design of the above-described type in that the stock rail 210, the side rail 212, and the slide plate 214 are separately manufactured components that are joined by metallurgical bonds to form a block. Thus the stock rail 210, the side rail 212, and the slide plate 214 replace the monoblock 12. In contrast, the lower part of the switching device corresponds to the above-described teaching, i.e. represents an elevated support, which comprises supports 22, 24, in particular made from structural steel, which originate from the base or mounting plate 26.

The teaching of the invention is again illustrated by FIGS. 15 to 18. In this, FIG. 15 corresponds to FIG. 1. In this, the superstructure device with the block 12, or the component parts of FIG. 14, and the lower part extends along the entire length of the switching device. In accordance with FIG. 16, the superstructure device extends from the entrance or beginning of the switching device along the entire switch support and at the end possesses—with respect to both the stock rail and the tongue blade—a welded-on standard-rail section.

In accordance with FIG. 17, the block on the tongue blade side is embodied all the way to the end of the switching device. On the other hand, the end region of the stock rail is a standard rail. The block itself originates from the entrance or beginning of the switching device and extends along the entire switch support.

In accordance with FIG. 18, with respect to the stock rail, the block is embodied from the beginning or entrance of the switching device to the end of the switching device. In contrast, outside of the switch support, the tongue blade is a standard rail.

FIG. 19 again illustrates variants possible in accordance with the invention's teaching. The figure shows a top view onto points where the overall length of a switching device in accordance with standard specifications is identified with the reference label 200. The fundamental length of the invention's monoblock design including the elevated support is identified by the reference label 202. Thus, the lengths 200, 202 are identical.

If constructional or site-specific deviations from the standard length are required, it is possible to shorten the monoblock, for example by a required length K. In FIG. 19 a shortening, labeled K, of the monoblock is indicated as an example both at the beginning and at the end of the monoblock. The actual length of the invention's monoblock in this embodiment example is consequently: 202-2K.

Standard rails then may be welded to the shortened monoblock and in accordance with the drawing may then exceed the standard length (reference label 200) of the switching device. The corresponding extensions are labeled V. Of course one also has the option of connecting standard rails to a monoblock of standard length 202 already at the factory, as illustrated in regions V.

Thus the actual total length 206 of the factory-produced switching devices can be longer than the switching device 200 according to standards.

Figure 4:
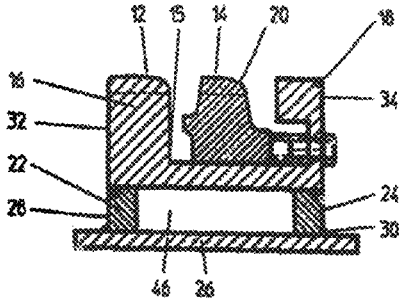
FIG. 4 shows a sectional view along C-C in FIG. 1.
Figure 3:
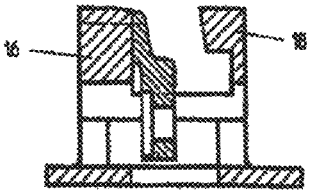
FIG. 3 shows a sectional view along B-B in FIG. 1.

The design of the various embodiment variants with respect to the block design and the lower part corresponds to that described in connection with FIGS. 3 to 5, as is also illustrated in the sections BB, CC, and DD.

The invention claimed is:

1. A superstructure device as a switching device for a set of points comprising a switch support with a slide plate for supporting a tongue blade in a movable manner, a stock rail, and a guide or side rail, spaced apart and delimiting said slide plate, wherein the switch support, the stock rail, and the guide or side rail are parts of a block made from high-tensile steel, wherein the block is connected with a metallurgical bond, to a lower part of the same material, or of a material different than a high-tensile steel, wherein the block extends along the length of the switch support and at least beyond one side of the switch support, wherein the lower part is an elevated support of the block in the form of at least two spaced apart supports, and wherein said superstructure device comprises a box-like body which delimits an interior space, and is delimited on the head side by the slide plate supporting the tongue blade of the set of points, and is delimited on the bottom side by the base or mounting plate, and in which a heater is arranged, which heater extends at a distance to the base or mounting plate, wherein the interior space is thermally insulated, at least towards the base or mounting plate, by insulation introduced into the interior space, wherein the heater is arranged between the insulation and the lower side of the slide plate.

2. The superstructure device of claim 1, wherein the block extends on both sides beyond the switch support along the entire length of the superstructure device.

3. The superstructure device of claim 1, wherein the block starts at an entrance of the superstructure device.

4. The superstructure device of claim 1, wherein the set of points has an exit side, and the block, within the superstructure device, is connected with a metallurgical bond on the exit side, on the stock rail side, and/or tongue blade side, to a standard rail.

5. The superstructure device of claim 1, wherein the superstructure device has an entrance section and an end section, and transition rail profiles that are welded to the block in the entrance and/or end section, and wherein the transition rail profiles extend outside of the switch support.

6. The superstructure device of claim 1, wherein the supports are embodied as a square profile, a sheet metal with rectangular cuboid geometry, or a steel profile forming a cuboid shape.

7. The superstructure device of claim 1, wherein the block is embodied as rolled sheet metal, or a forged body, that is processed by laser cutting, autogenous cutting, plasma cutting, or milling.

8. The superstructure device of claim 1, wherein when R is 25 m, the length of the block is approximately 4900 mm;

when R is 30 m, the length of the block is approximately 4600 mm;

when R is 50 m, the length of the block is approximately 5350 mm;

when R is 100 m, the length of the block is approximately 7200 mm;

when R is 150 m, the length of the block is approximately 8500 mm;

where R =a radius of the set of points.

9. The superstructure device of claim 1, wherein the block possesses a width of approximately 370 mm and/or a height of approximately 100 mm.

10. The superstructure device of claim 1, wherein the two supports forming the elevated support are connected with metallurgical bond to a base or mounting plate.

11. The superstructure device of claim 1, wherein the insulation extends at some distance to the base plate.

12. The superstructure device of claim 1, wherein the insulation forms a body with a U-shaped cross section, with cross arms that extend along the base or mounting plate, and longitudinal arms that extend along the inner sides of the supports.

13. The superstructure device of claim 1, wherein the insulation forms a body with an L-shaped cross section, with longitudinal arms that extend along the base or mounting plate, and a short arm that extends along the inner side of one of the supports.

14. The superstructure device of claim 1, wherein the insulation consists of sections of different materials.

15. The superstructure device of claim 1, wherein the insulation is covered towards the space accommodating the heater by a thermal shield plate.

16. The superstructure device of claim 1, wherein the insulation consists of rock wool, or one or several insulating boards.

17. The superstructure device of claim 1, wherein the insulation is introduced into the interior space in loose form, or by foaming or pouring.

18. The superstructure device of claim 1, wherein the thermal shield plate is a rust-free sheet metal such as a sheet of stainless steel.

19. The superstructure device of claim 1, wherein the tongue blade, in its root region, is fastened to the block via a wedge element.

20. The superstructure device of claim 1, wherein, in the outer side of the stock rail, and/or the side rail, extends a recess, and that in the recess extends insulation up to a height above the top side of the slide plate.

21. The superstructure device of claim 1, wherein on the outside, the insulation is closed.

22. The superstructure device of claim 1, wherein on the outside, the insulation is closed or covered by a sheet metal, or a support that supports the switch support.

23. The superstructure device of claim 1, wherein the support supporting the switch support possesses, on the switch-support side, spaced apart projections having a comb-like geometry, on which the switch support is supported.

24. The superstructure device of claim 1, wherein gaps extending between the projections are filled with sections of an insulation, which form a unit with insulation arranged in the interior space, or blend into said insulation.

25. The superstructure device of claim 1, wherein the insulation extends along the lower side of the slide plate, and/or outer side of the stock rail, all the way or nearly all of the way to a region where the tongue blade contacts the slide plate or the stock rail.

26. A superstructure device as a switching device with a switch support consisting of a steel of high-strength quality, comprising a stock rail, a side rail, and a slide plate supporting a tongue blade of a set of points in a movable manner, wherein the switch support is a part of a block connected to a lower part made from the same material, or a material different from high-tensile steel, wherein said block comprises individual components, connected by metallurgical bonds, in the form of the stock rail, the slide plate, and the side rail, wherein the block extends over the length of the switch support, as well as beyond at least one side of the switch support, wherein the lower part is an elevated support of the block in the form of at least two spaced apart supports, and wherein said superstructure device comprises a box-like body which delimits an interior space, and is delimited on the head side by the slide plate supporting the tongue blade of the set of points, and is delimited on the bottom side by the base or mounting plate, and in which a heater is arranged, which heater extends at a distance to the base or mounting plate, wherein the interior space is thermally insulated, at least towards the base or mounting plate, by insulation introduced into the interior space, wherein the heater is arranged between the insulation and the lower side of the slide plate.

* * * * *